US006422983B1

(12) United States Patent
Weck

(10) Patent No.: US 6,422,983 B1
(45) Date of Patent: Jul. 23, 2002

(54) INFLATABLE DEVICE AND METHOD FOR USING THE DEVICE

(75) Inventor: David S. Weck, New York, NY (US)

(73) Assignee: D. W. Fitness, LLC, Madison, NJ (US)

( * ) Notice: Subject to any disclaimer, the term of this patent is extended or adjusted under 35 U.S.C. 154(b) by 0 days.

(21) Appl. No.: 09/411,997

(22) Filed: Oct. 4, 1999

(51) Int. Cl.[7] ..... A63B 21/00
(52) U.S. Cl. ..... 482/147; 482/146; 482/148
(58) Field of Search ..... 297/452.41; 5/655.3, 5/654, 706; 482/23, 30, 31, 142, 130, 146, 147, 77, 148

(56) References Cited

U.S. PATENT DOCUMENTS

| | | | | | |
|---|---|---|---|---|---|
| 1,755,205 | A | * | 4/1930 | Christensen | 5/654 |
| 2,077,233 | A | * | 4/1937 | Greenhill | 5/368 |
| 2,521,530 | A | * | 9/1950 | McGuffage | 5/368 |
| 2,991,589 | A | * | 12/1961 | Ayala | 446/225 |
| 3,024,021 | A | | 3/1962 | Coplin et al. | 282/57 |
| 3,356,367 | A | | 12/1967 | Tewksbury | |
| 3,421,163 | A | * | 1/1969 | Stoughton | 5/654 |
| 3,627,314 | A | | 12/1971 | Brown | 482/77 |
| 3,716,229 | A | | 2/1973 | Van Der Cleyen et al. | 272/57 E |
| 4,065,124 | A | | 12/1977 | Egan | |
| 4,067,078 | A | * | 1/1978 | Winston | 5/368 |
| 4,159,826 | A | | 7/1979 | Hancock | 272/65 |
| 4,263,682 | A | * | 4/1981 | Bejarno | 3/36 |
| 4,516,767 | A | | 5/1985 | Eskijian | 272/65 |
| 4,516,768 | A | | 5/1985 | Gallaro | 272/65 |
| 4,801,140 | A | | 1/1989 | Bergeron | 272/146 |
| 4,893,229 | A | | 1/1990 | Blankenzee | 272/114 |
| 5,048,823 | A | | 9/1991 | Bean | 272/111 |
| 5,116,045 | A | | 5/1992 | Jahoda | |
| 5,333,336 | A | * | 8/1994 | Langsam | 5/654 |
| D361,604 | S | | 8/1995 | Stroppiana | D21/66 |
| 5,549,536 | A | | 8/1996 | Clark | 482/146 |
| 5,643,154 | A | | 7/1997 | Awbrey et al. | 482/111 |
| 5,643,165 | A | | 7/1997 | Klekamp | 482/146 |
| 5,810,703 | A | | 9/1998 | Stack | 482/146 |
| 5,881,407 | A | * | 3/1999 | Chu | 5/654 |
| 6,012,188 | A | * | 1/2000 | Daniels et al. | 5/654 |

FOREIGN PATENT DOCUMENTS

| | | |
|---|---|---|
| DE | 20 32 544 A | 1/1972 |
| DE | 31 50 189 A | 7/1983 |
| DE | 36 20 706 A | 12/1987 |
| EP | 0 134 047 A | 3/1985 |

OTHER PUBLICATIONS

Duradisk Wobble Board, etc., www.paulchekseminars.com.
Exercise Balls; Gymnic Line, etc., www.balldynamics.com.
Dyna–Disc Pillow, etc., Perform Better.
Disc'O'Sit Air Cushion, etc., www.balldynamics.com.

(List continued on next page.)

*Primary Examiner*—Jerome W. Donnelly
(74) *Attorney, Agent, or Firm*—Lerner, David, Littenberg, Krumholz & Mentlik, LLP

(57) ABSTRACT

An inflatable device can be used for physical therapy, conditioning or training. The device has a support platform and a flexible member. The flexible member is affixed to, and has a bowl-shaped distention projecting from, one side of the platform. This flexible member is inflatable to a pressure for supporting a person. The device is inflated before placing at least some of the weight of a person on the device. When the person wishes to later change the characteristics of the device, the pressure in the inflatable device can be changed to change its stability.

43 Claims, 2 Drawing Sheets

OTHER PUBLICATIONS

Duradisk, etc., www.paulchekseminars.com.
Sit Fit, www.rpsportsinc.com/balance.htm.
K.A.T. 2000, www.oemmedical.com (2 pp.).
K.A.T. 500 product sheet.
Lower Extremity, Exercise Equipment (K.A.T. Products).
K.A.T. 550 product description.
www.myfitnesstrainer.net, 4 selected screen shots (printed Feb. 26, 2001).
JUMP BOARD: Digital Phtographs showing a toy called a "jump board" made by Hedstrom Corporation.
Dursdisk Wobble Board, etc. www.paulchekseminars.com.
Exerise Balls; Gymnic Line, etc., www.balldynamics.com.
Dyna–Disc Pillow, etc., Perform Better.
Disc'O'Sit Air Cushion, etc., www.balldynamics.com.
K.A.T. 500 product sheet.
Lower Extremity, Exercise Equipment (K.A.T. Products).
K.A.T. 555 product description.
Pogo Ball Drawing.
Duradisk, etc., www.paulchekseminars.com.
Sit Fit, www.rpsportsinc.com/balance.htm.
K.A.T. 2000, www.oemmedical.com (2 pp.).

* cited by examiner

INFLATABLE DEVICE AND METHOD FOR USING THE DEVICE

BACKGROUND OF THE INVENTION

1. Field of the Invention

The present invention relates to devices for physical therapy, conditioning or training, and in particular to inflatable devices.

2. Description of Related Art

Many devices are known for facilitating exercises done for therapy, conditioning or physical training. Other than variable resistance training equipment, these devices have not usually offered much adjustability to allow for exercises at different degrees of difficulty. Also, many of these devices have been dedicated to very specific exercises and therefore do not justify a significant investment of space and financial resources for such a narrow purpose.

Some exercise devices require a person to maintain balance and equilibrium. A large inflatable ball (for example, 65 cm), known as a Swiss ball, has been used for this purpose. While the ball is useful for certain stability training exercises, standing upon the ball or staying atop the ball requires a high degree of skill and is inappropriate for most.

In U.S. Pat. No. 4,801,140 a person suffering from a physical disability can stand on the flat side of a non-inflatable molded foam hemisphere to practice balancing. The practical disadvantage of this design is that a high degree of skill is required before someone can actually stand on such an unstable platform. Without assistance from a therapist or additional balancing accessories, this platform is accessible only to trained athletes.

In U.S. Pat. No. 5,810,703 the underside of a small board is fitted with a smaller spherical projection. The relatively small diameter of the spherical projection tends to make the board relatively unstable. The height of the spherical projection can be set to one of three discrete settings. Overall, the adjustment has little range and resolution. Also, the projection, if inverted to face upwardly, is too small to allow a person to perform an exercise while placing weight on the projection.

An inflated cushion in the shape of a disk (sold under the name DuraDisk through C.H.E.K. Institute) has been described as useful for certain exercises. This cushion is described as needing no inflation, but the product is shipped with an inflation valve that the user has access to. A separate wooden platform, 20 inches in diameter, is sold for the purpose of placing the platform over the cushion to create a balance board. This cushion is relatively flat and therefore offers little challenge to a user. It is not useful for the inflatable disk to be placed on the board as this would offer no advantage over putting the inflatable disk on the floor. Also, the use of a separate platform requires careful placement and centering of the platform and also introduces the need for regularly finding and associating the separate parts.

In U.S. Pat. No. 5,643,154 a relatively squat, rounded ballast is mounted under a relatively wide platform. If the user is willing to stock an inventory, the rounded ballast can be a changed, but the individual ballasts are not adjustable. This device is designed for use on land or in water. For use in water, an edge bumper is inflated an adjustable amount to reach the desired buoyancy. While this edge bumper is adjustable, this adjustment is only effective in water. The stability of the platform on land will not be substantially affected by adjusting an edge bumper, which inherently provides a stable base. See also U.S. Pat. No. 3,024,021 for a non-adjustable device employing a platform connected through a resilient member to a rounded base.

U.S. Pat. No. 5,643,165 shows a frustroconical balancing device with a flattened apex. This device is stable in only one central position, and becomes highly unstable once tilted slightly. Furthermore, the stability of this device is not adjustable. See also U.S. Pat. No. 5,549,536 for a continually tilted platform.

Accordingly, there is a need for an improved device that can allow adjustment, preferably with an inflatable device, to accommodate persons with different levels of skills and capabilities.

SUMMARY OF THE INVENTION

In accordance with the illustrative embodiments demonstrating features and advantages of the present invention, there is provided a device for physical therapy, conditioning or training. The device has a support platform and a flexible member. The flexible member is affixed to, and has a bowl-shaped distention projecting from, one side of the platform. This flexible member is inflatable to a pressure for supporting a person.

In accordance with another aspect of the invention there is provided, a method for physical therapy, conditioning or training. The method employs an inflatable device having a flexible member distending from a platform. The method includes the step of inflating the inflatable device. Another step is placing at least some of the weight of a person on said inflatable device. The method also includes the steps of removing the weight of the person and changing the pressure in the inflatable device to change its stability. Another step is again placing at least some of the weight of a person on said inflatable device.

By employing devices and methods of the foregoing type, a variety of exercises can be performed by persons of varying levels of skills and capabilities. In a preferred embodiment a flexible, sheet-like member is affixed along the edge of a rigid circular platform, though other non-circular outlines are contemplated. This preferred, sheet-like member can be inflated by a valve installed, for example, in the center of the platform. When inflated, the flexible, sheet-like member forms a domed or hemispherical surface, at least before being loaded.

In some embodiments a circular panel can be attached to the underside of the platform to sandwich between them an edge of the flexible, sheet-like member. The edge of the platform may have an upwardly extending lip formed by either rolling the edge of the platform, or by attaching a bead to the platform's edge. In some embodiments the edge of the flexible, sheet-like member can be sandwiched between the bead and the platform.

In some cases the user may place the flexible, sheet-like member on the ground and then stand on the platform to enhance the user's balance. The stability of the platform can be altered by adjusting the pressure behind the flexible, sheet-like member. In other cases the user may place the platform on the ground and then stand on the inflated flexible, sheet-like member. This orientation may facilitate balance exercises, or toe extensions that exercise the calves. Numerous other exercises can be performed when the person uses the flexible, sheet-like member for sitting or supporting a hand, foot, extremity, etc., while performing situps, squats, lunges, etc.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
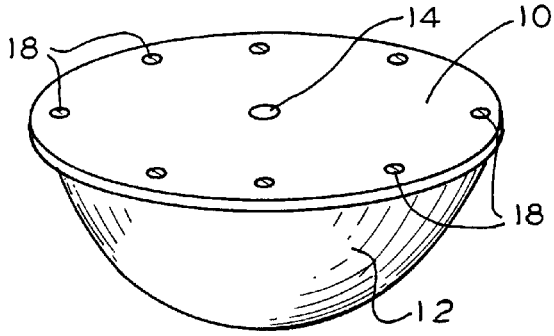
FIG. 1 is an axonometric view of a device in accordance with principles of the present invention.
Figure 2:
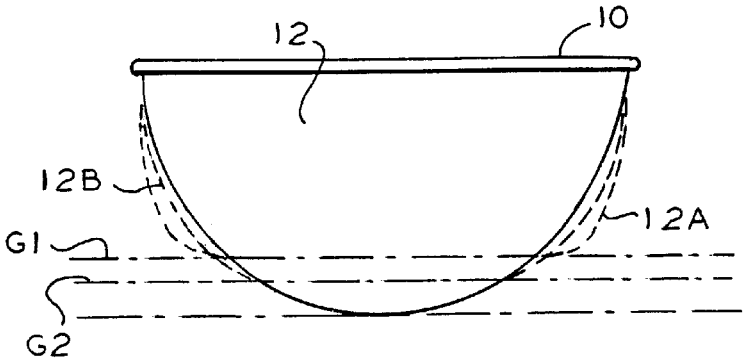
FIG. 2 is a side elevational view of the device of FIG. 1, showing various levels of distension.

Referring to FIGS. 1 and 2, the illustrated device has a support platform 10 with a circular outline, although other outlines are contemplated (elliptical, polygonal, etc.). Platform 10 can be made of wood, plastic, metal, or other materials. A flexible sheet-like member in the form of an elastomeric sheet 12 is shown secured to the edge of platform 10. The edge of sheet-like member 12 is attached with an airtight seal to platform 10 by glueing, by clamps, or by other sealing means. Sheet-like member 12 can be made of any one of a variety of materials, including natural and synthetic rubbers, plastics, etc. Also, in some embodiments sheet-like member 12 may be a laminate having an outer surface that is more durable and skid resistant.

Sheet-like member 12 may be formed by blow molding or otherwise to have a natural hemispherical shape. This hemispherical shape preferably has a diameter of 18 to 36 inches (46 to 91 cm), although other dimensions are contemplated. It will be appreciated, however, that under normal use, and when loaded, the sheet-like member 12 will have a profile that is more complex than a hemisphere. In other embodiments, sheet-like member 12 may start as a flat circular sheet that distends when inflated into a dome (taking essentially a hemispherical shape when unloaded).

A valve means 14 is mounted in a center hole in platform 10. The valve means 14 may be a rubber bushing covered on its inside with a flexible flap that acts as a check valve. Valves of this type are used to inflate basketballs, footballs, etc. If the device need only be inflated to a relatively low pressure, a tube with a stopper can permit a user to blow into the tube to inflate the device, as is done with inflatable beach balls, and the like. Various other types of valves can be used in different embodiments, depending upon the desired pressure, pumping method, etc. Also, valve 14 can be located on alternate positions on platform 10, or on various positions on sheet-like member 12.

Figure 3:
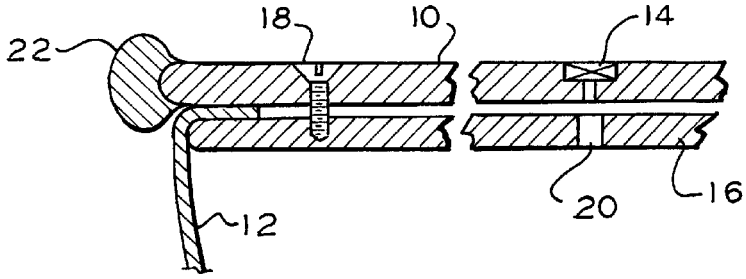
FIG. 3 is a detailed, fragmentary, cross-sectional view of the device of FIG. 1, but modified to include an additional bead.

Referring to FIGS. 1 and 3, a circular deck 16 is shown as an element attached to the underside of platform 10 by means of screws 18, although other types of fasteners may be used instead. The edge of sheet-like member 12 is shown sandwiched between platform 10 and underlying deck 16. The seal at the edge of sheet-like member 12 can be enhanced by using an appropriate glue, caulk, gasket compound, or other sealing material. The hole holding valve means 14 is aligned with hole 20 in underlying deck 16, although such alignment is unnecessary, and in some embodiments a number of spaced holes may be used instead. Platform 10 and deck 16 may be made of different materials, so that the outer surface may be flexible and skid proof, while the inside deck may be rigid and able to bear heavy loads. In still other embodiments, underlying deck 16 may be replaced with a hoop or other annular structure to simply concentrate on its function of acting as an affixing means for sealing sheet-like member 12 to platform 10.

The edge of platform 10 is fitted with an annular bead 22. Bead 22 may be secured by glueing or by various fasteners. Also, bead 22 may have a variety of shapes. Bead 22 can be formed of a length of extruded rubber or plastic that is closed into a loop. Alternatively, bead 22 may be initially molded as an annulus. Preferably, the top of bead 22 rises above the surface of platform 10 to provide a small barrier that tends to keep a user's feet on the platform. Also in preferred embodiments, bead 22 may be relatively soft material that prevents injury caused by the user accidentally kicking or otherwise colliding with the edge of platform 10.

Figure 4:
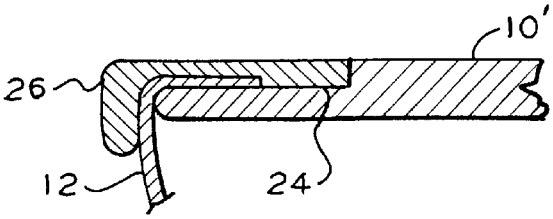
FIG. 4 is a detailed, fragmentary, cross-sectional view of a device that is an alternate to that of FIG. 2.

Referring to FIG. 4, alternate platform 10' is similar to the previously described platform, but with a peripheral recess 24. An annular bead 26 is shown fitted in recess 24, while sandwiched between them is previously mentioned sheet-like member 12. As before, bead 26 may be a molded annulus or may be formed from a length of extruded material that is closed into a loop. Alternatively, the edge of sheet-like member 12 may be sealed into recess 24 before molding bead 26 in situ. Bead 26 has an outside surface that is coplanar with the outside surface of platform 10' to facilitate situations where the device is placed with platform 10' down, for certain exercises to be described presently.

Figure 5:
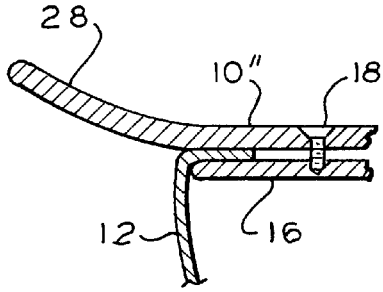
FIG. 5 is a detailed, fragmentary, cross-sectional view of a device that is an alternate to that of FIG. 2.

Referring to FIG. 5, previously mentioned deck 16 is shown attached by means of screws 18 to alternate platform 10". Also as before, sheet-like member 12 is sandwiched between elements 10" and 16. Platform 10" has an integral edge 28 that is rolled. Platform 10" maybe shaped by molding, stamping, bending, etc.

Figure 6:
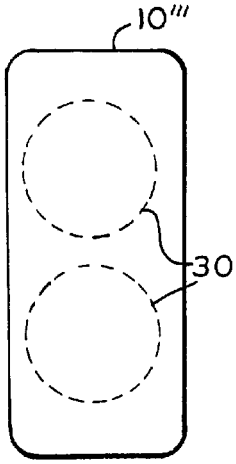
FIG. 6 is a plan view of a device that is an alternate to that of FIG. 1.

Referring to FIG. 6, an alternate platform 10''' is generally rectangular with rounded corners. Platform 10''' to be dimensioned to simulate the general size and feel of a skate board or snowboard. Here, two inflatable domes 30 are sealed to the underside of platform 10''' using structure and techniques similar to that previously described. The domes 30 are arranged so that the platform 10''' can roll (rotation about a longitudinal axis) fairly easily, but cannot pitch unless the user places significant weight at the front or back of the platform 10'''.

To facilitate an understanding of the principles associated with the foregoing apparatus, the use of the device of FIG. 1 will be briefly described. The user will initially inflate the device by inserting a pump needle through valve means 14. The sheet-like member 12 will be inflated and will distend accordingly. With a modest level of inflation, sheet-like member 12 will take the hemispherical shape 12A shown in FIG. 2 when unloaded (that is, when suspended so that the sheet-like member 12 does not touch the ground).

Figure 7A:
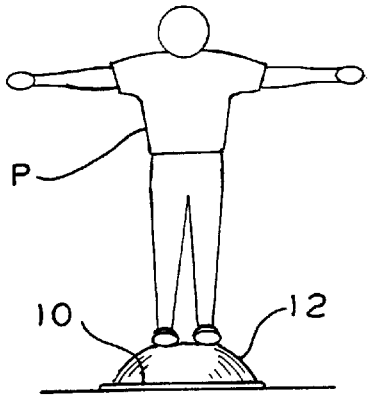
FIGS. 7A–7D show the device of FIG. 1 being used in a variety of exercises.

The foregoing device may be used with the platform 10 resting on the ground as shown in FIG. 7A. Here, a person P stands on sheet-like member 12, working to maintain balance. For an especially challenging session, a person can stand on one foot. The difficulty can be further increased if the person to P rolls or tilts the head, with or without the eyes closed. Another, surprisingly challenging session can consist of simply kneeling on the sheet-like member 12. This effort can be reduced for a novice by getting down on all fours and then working to maintain balance.

The person P may mount sheet-like member 12 in order to receive various benefits. The user may perform an exercise in order to improve the user's sense of balance. In some cases, the user may suffer from a disability that affects coordination and balance. Therefore, the device can be used to improve motor skills and balance as a form of therapy. In other cases, an athlete may wish to improve balance for any one of a number of sports requiring a refined sense of balance. Alternatively, the user may stand on member 12 simply to exercise his or her muscles. Of course, some users will stand on member 12 simply for enjoyment.

The amount of exercise sustained by mounting the device can be substantial. The person maintaining balance will normally be required to make many rapid and urgent posture adjustments by exerting a wide range of muscles. Moreover, this effort takes place with a sense of stimulation and excitement that makes the effort challenging and interesting. Thus, the user can quickly reach a high level of exertion without the usual sense of tedium or labor.

As the user's balance, coordination, and endurance improve, the user may wish to increase the level of difficulty. Accordingly, the pressure within the device can be decreased by venting valve means 14. This reduced pressure leads to less sure footing and increased effort to maintain balance. Alternatively, the pressure can be increased to accommodate an especially difficult routine, or to accommodate a user that is tired or less experienced. This increased pressure corresponds to more stability, since the sheet-like member 12 is less able to shift underneath the user. An advantage with the foregoing pressure adjustment is that the user can continuously and finely adjust the pressure and the level of difficulty to suit his or her personal needs.

Because the device can be adjusted to become relatively stable, the user can readily perform ordinary exercises. For example, the user can squat, or stretch and stand on his or her toes as an exercise. Such exercises provide the dual benefit of conditioning muscles, while simultaneously training a person to maintain balance. Other exercises are contemplated, such as leg kicks, knee lifts, etc.

Figure 7B:
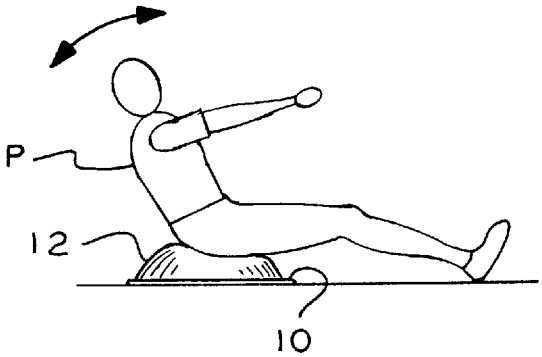

A person P can also sit on sheet-like member 12 as shown in FIG. 7B to perform situps. Here, the user can decrease the level of difficulty by shifting forward to reduce the amount of upper body weight that is cantilevered out past the device. An additional advantage is that sheet-like member 12 can conform to the user's body and support the lower back as the user leans back.

Decreasing the pressure within sheet-like member 12 can increase the amount of lower back support under such circumstances.

Figure 7C:
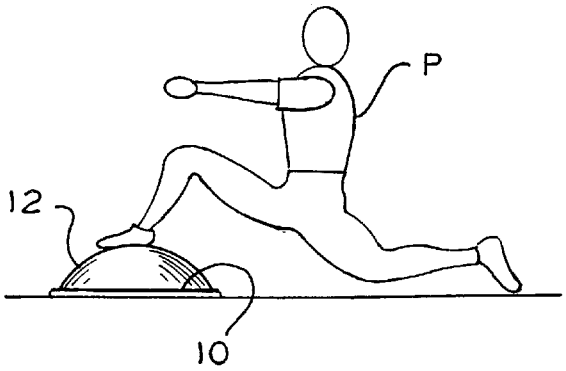

Various other exercises can be performed on the inverted device. As shown in FIG. 7C, person P can perform lunges. In fact, many of the exercises that are performed in step aerobics classes can be performed with the presently disclosed device. One advantage with this mode of use is that the exercise is very low impact, since sheet-like member 12 acts like a cushion. Again, the pressure behind sheet-like member 12 can be adjusted to change the level of difficulty. Also, the cushioning effect of sheet-like member 12 can make the exercises low impact, which is very important in step aerobics in order to avoid the joint injury that commonly occur with long-term use.

Figure 7D:
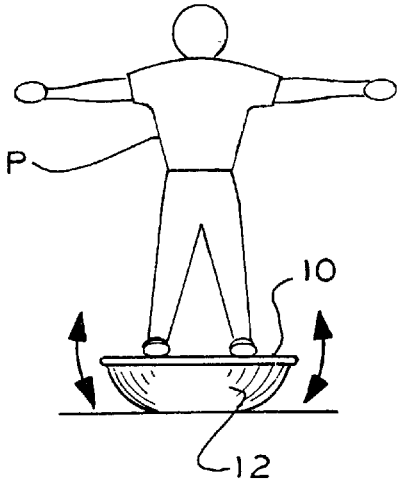

The foregoing device need not be used with the platform down, but may be inverted at shown in FIG. 7D. Because the device is inherently less stable when inverted as in FIG. 7D, the user will receive a more vigorous experience, which may be appropriate for athletic training.

When placed on the ground (level G1 of FIG. 2) in order to support a person as shown in FIG. 7D, sheet-like member 12 will become more squat and take the outline 12A shown in phantom in FIG. 2. This is a relatively stable condition and the user can maintain balance while standing on platform 10 without too much difficulty.

Pressure can then be increased by reattaching a pump to valve means 14. Sheet-like member 12 may then be pressurized to distend further and take the outline 12B shown in phantom in FIG. 2, when placed on the ground at level G2. Outline 12B is closer to hemispherical and will make the platform 10 less stable. If the device is built sufficiently strong to sustain a very high pressure, sheet-like member 12 can distend to the almost precisely hemispherical shape shown in full line in FIG. 2. This represents the highest level of difficulty, requiring a high level of skill and endurance.

Obviously, many modifications and variations of the present invention are possible in light of the above teachings. It is therefore to be understood that within the scope of the appended claims, the invention may be practiced otherwise than as specifically described.

What is claimed is:

1. A device for physical therapy, conditioning or training, comprising:

a support platform having a first side and a second side, the second side of the platform structured and arranged for stable resting on the ground;

an inflatable, flexible member affixed to and extending upwards over the first side of the platform, said flexible member being substantially hemispherical when affixed to the platform and inflated; and a clamp clamping the flexible member in between the clamp and support platform to affix the flexible member to the platform such that the flexible member extends upwards over the first side.

2. A device according to claim 1 wherein said flexible member is elastomeric.

3. A device according to claim 1 wherein said platform has a substantially circular border.

4. A device for physical therapy, conditioning or training, comprising:

a support platform having a border; and a flexible member affixed to, and having a bowl-shaped distention projecting from one side of, said platform, said flexible member being inflatable to a pressure for supporting a person and the border of said platform being rolled in a direction away from the flexible member.

5. A device according to claim 1 comprising:

valve means adapted to communicate a source of pressure for changing pressure within said flexible member, in order to adjust said device and change its support stability.

6. A device for physical therapy, conditioning or training, comprising:

a support platform having two sides, one side of the platform structured and arranged for stable resting on the ground;

a flexible member affixed to, and having a bowl-shaped distention projecting from the other side of, said platform, said flexible member being inflatable to a pressure for supporting a person and being substantially hemispherical before bearing a load; and valve means adapted to communicate a source of pressure for changing pressure within said flexible member, in order to adjust said device and change its support stability and wherein said valve means is located on said flexible member.

7. A device according to claim 5 wherein said valve means is located on said platform.

8. A device according to claim 5 wherein said valve means is centrally located on said platforms.

9. A device according to claim 6 wherein said platform has an outer support surface adapted for standing upon.

10. A device for physical therapy, conditioning or training, comprising:

a support platform having two sides, one side of the platform structured and arranged for stable resting on the ground;

a flexible member affixed to, and having a bowl-shaped distention projecting from the other side of, said platform, said flexible member being inflatable to a pressure for supporting a person and being substantially hemispherical before bearing a load; and valve means adapted to communicate a source of pressure for changing pressure within said flexible member, in order to adjust said device and change its support stability;

wherein said platform has an outer support surface adapted for standing upon and said flexible member has an outside surface adapted for standing upon.

11. A device according to claim 1 wherein said flexible member comprises a sheet-like member.

12. A device for physical therapy, conditioning or training, comprising:

a support platform having two sides, one side of the platform structured and arranged for stable resting on the ground;

a flexible member comprising a sheet-like member being affixed to, and having a bowl-shaped distention projecting from the other side of, said platform, said flexible member being inflatable to a pressure for supporting a person and being substantially hemispherical before bearing a load; and affixing means for affixing said sheet-like member to said platform.

13. A device for physical therapy, conditioning or training, comprising:

a support platform having two sides, one side of the platform structured and arranged for stable resting on the ground;

a flexible member affixed to, and having a bowl-shaped distention projecting from the other side of, said platform, said flexible member being inflatable to a pressure for supporting a person and being substantially hemispherical before bearing a load; and an annular bead peripherally secured to said platform.

14. A device for physical therapy, conditioning or training, comprising.

a support platform;

an annular bead peripherally secured to said platform;

a flexible member affixed to, and having a bowl-shaped distention projecting from one side of, said platform, said flexible member being sandwiched between said bead and said platform and being inflatable to a pressure for supporting a person.

15. A device according to claim 14 wherein said platform has an inside and an outside face, said bead being attached upon said outside face of said platform.

16. A device according to claim 1 wherein said flexible member comprises:

a plurality of domes attached to one side of said platform.

17. A method for physical therapy, conditioning or training, employing an inflatable device having a flexible member distending from a platform, the method comprising the steps of:

inflating said inflatable device to form a domed surface adjacent a relatively flat surface;

supporting at least some of the weight of a person by compressing said inflatable device at or adjacent to the center of [on] said inflatable device;

removing the weight of the person;

changing the pressure in said inflatable device to change its stability; and replacing at least some of the weight of a person on said inflatable device.

18. A method according to claim 17 comprising the step of:

laying said inflatable device down with the flexible member up before placing at least some of the weight of a person on said inflatable device.

19. A method according to claim 17 comprising the step of:

laying said inflatable device down with the platform up before placing at least some of the weight of a person on said inflatable device.

20. A method according to claim 17 wherein the step of changing the pressure is performed in a manner to change stability of said inflatable device.

21. The device of claim 4 or 14 wherein an edge of the support platform rises beyond the surface of the other side of the support platform so that the center of the other side does not contact the ground when the other side is placed on a ground plane, the other side being opposite to said one side.

22. The device of claim 4 or 14 wherein the support platform further includes an annular bead affixed to the edges of the support platform such that the annular bead rises above the surface of the other side of the support platform.

23. The device of claim 4 or 14 wherein the flexible member is elastomeric.

24. The device of claim 4 or 14 wherein the platform has a substantially circular border.

25. The device of claim 17 wherein the border of said platform is rolled away from the flexible member.

26. The device of claim 4 or 14 wherein the flexible member is substantially hemispherical before bearing a load.

27. The device of claim 4 or 14 further including a valve adapted to communicate a source of pressure for changing pressure within said flexible member, in order to adjust said device and change its support stability.

28. The device of claim 27, wherein the valve is located on the flexible member.

29. The device of claim 27, wherein the valve is located on the platform.

30. The device of claim 27 wherein the valve is centrally located on the platform.

31. The device of claim 4 or 14 wherein the platform has an outer support surface adapted for standing upon.

32. The device of claim 4 or 14 wherein the flexible member has an outside surface adapted for standing upon.

33. The device of claim 4 or 14 wherein the flexible member comprises a sheet-like member.

34. The device of claim 4 further including an element secured to said platform, the flexible member being sandwiched between the element and the platform such that the flexible member is affixed to said platform.

35. The device of claim 34 wherein the platform has an outside and an inside face, the element being secured to the inside face of said platform.

36. The device of claim 4 further including an annular bead peripherally secured to the platform.

37. The device of claim 36 wherein the flexible member is sandwiched between the bead and the platform.

38. The device according to claim 37, wherein the platform has an inside and an outside face, the bead being attached upon the outside face of the platform.

39. A method of using a device for physical therapy, conditioning or training, the device comprising: a support platform having a first side and a second side, the second side of the platform structured and arranged for stable resting on the ground; an inflatable, flexible member affixed to and extending upwards over the first side of the platform, said flexible member being substantially hemispherical when affixed to the platform and inflated; and a clamp clamping the flexible member in between the clamp and support platform to affix the flexible member to the platform such that the flexible member extends upwards over the first side; said method comprising:

inflating the flexible member, placing the support platform on the ground such that the platform is at rest and the flexible member projects away from the support platform and the ground, and placing at least some of the weight of a person on the flexible member.

40. The method of claim 39 further including the step of changing the pressure in the flexible member after the step of placing at least some of the weight of a person on the flexible member.

41. A method of using a device for physical therapy, conditioning or training, comprising a support platform and flexible member affixed to, and having a bowl-shaped distention projecting from one side of, said platform, said flexible member being inflatable to a pressure for supporting a person and substantially hemispherical before bearing a load, said method comprising:

inflating the flexible member, placing the support platform on the ground such that the platform is at rest and the flexible member projects away from the support platform and the ground, and placing at least some of the weight of a person on the flexible member, wherein the border of the platform is rolled in a direction away from the flexible member.

42. The method of claim 39 wherein the device further includes an element secured to the platform, the flexible member being sandwiched between said element and said platform such that the flexible member is affixed to said platform.

43. A method of using a device for physical therapy, conditioning or training, comprising a support platform and flexible member affixed to, and having a bowl-shaped distention projecting from one side of, said platform, said flexible member being inflatable to a pressure for supporting a person and substantially hemispherical before bearing a load, said method comprising:

inflating the flexible member, placing the support platform on the ground such that the platform is at rest and the flexible member projects away from the support platform and the ground, and placing at least some of the weight of a person on the flexible member, wherein the device further includes an annular bead peripherally secured to the platform such that the flexible member is sandwiched between said bead and said platform.

* * * * *

UNITED STATES PATENT AND TRADEMARK OFFICE

CERTIFICATE OF CORRECTION

PATENT NO. : 6,422,983 B1
DATED : July 23, 2002
INVENTOR(S) : David Weck

It is certified that error appears in the above-identified patent and that said Letters Patent is hereby corrected as shown below:

Column 5,
Line 51, should not be a new paragraph.

Column 7,
Line 9, “platforms” should read -- platform --.
Line 10, “claim 6” should read -- claim 5 --.

Column 8,
Line 12, delete the word “[on]”.
Line 46, “claim 17” should read -- claim 14 --.
Line 54, delete “,” after “27”.
Line 56, delete “,” after “27”.

Column 9,
Line 10, delete “,” after “37”.

Signed and Sealed this

Seventh Day of January, 2003

JAMES E. ROGAN
*Director of the United States Patent and Trademark Office*